US007352272B2

(12) United States Patent
Wang et al.

(10) Patent No.: US 7,352,272 B2
(45) Date of Patent: Apr. 1, 2008

(54) OVER-CURRENT PROTECTION DEVICE

(75) Inventors: David Shau Chew Wang, Taipei (TW); Jyh Ming Yu, Kaohsiung (TW); Kuo Chang Lo, Taipei (TW)

(73) Assignee: Polytronics Technology Corporation, Hsinchu (TW)

( * ) Notice: Subject to any disclaimer, the term of this patent is extended or adjusted under 35 U.S.C. 154(b) by 0 days.

(21) Appl. No.: 11/644,364

(22) Filed: Dec. 22, 2006

(65) Prior Publication Data

US 2007/0187655 A1 Aug. 16, 2007

(30) Foreign Application Priority Data

Feb. 15, 2006 (TW) ..... 95105010 A

(51) Int. Cl.
*H01C 7/10* (2006.01)

(52) U.S. Cl. ..... 338/22 R; 338/328; 252/511

(58) Field of Classification Search ..... 338/22 R, 338/328, 332; 252/511–513, 518–519
See application file for complete search history.

(56) References Cited

U.S. PATENT DOCUMENTS 5,793,276 A * 8/1998 Tosaka et al. ..... 338/22 R
6,452,476 B1 * 9/2002 Handa ..... 338/22 R
6,593,844 B1 * 7/2003 Iwao et al. ..... 338/22 R
6,778,062 B2 * 8/2004 Handa et al. ..... 338/22 R

* cited by examiner

*Primary Examiner*—K. Richard Lee
(74) *Attorney, Agent, or Firm*—Seyfarth Shaw LLP

(57) ABSTRACT

An over-current protection device comprises two metal foils and a PTC material layer laminated between the two metal foils. The PTC material layer essentially comprises a polymer matrix and a conductive filler. The polymer matrix at least comprises a first crystalline polymer, e.g., LDPE, and a second crystalline polymer, e.g., PVDF, in which the melting temperature of the second crystalline polymer subtracting the melting temperature of the first crystalline polymer is equal to or more than 50° C. The conductive filler is selected from metallic grain of a volumetric resistivity less than 500 μΩ-cm, and is distributed in the polymer matrix. The initial volumetric resistivity of the PTC material layer is less than 0.1Ω-cm, and the trip temperature of the PTC material layer at which the resistance thereof increases to 1000 times the initial resistance subtracting the melting temperature of the first crystalline polymer is less than 15° C.

10 Claims, 2 Drawing Sheets

OVER-CURRENT PROTECTION DEVICE

BACKGROUND OF THE INVENTION (A) Field of the Invention

The present invention is related to an over-current protection device, more specifically, to an over-current protection device for low load applications.

(B) Description of the Related Art

Because the resistance of positive temperature coefficient (PTC) conductive composite material is sensitive to temperature variation, it can be used for current sensing devices and is widely used for over-current protection devices or circuits. The resistance of PTC conductive composite materials can be kept extremely low at room temperature so that the circuit can operate normally. However, if an over-current or an over-temperature event occurs, the resistance will immediately increase to a high resistance state (e.g., above $10^4\Omega$.) Therefore, the over-current will be eliminated and the objective to protect the circuit device will be achieved.

Generally, PTC conductive composite material comprises at least one crystalline polymer and conductive filler. The conductive filler is uniformly distributed into the polymer. The polymer can be polyolefin polymer, e.g., polyethylene, and carbon black is in wide use as the conductive filler. In the past, portable electronic devices are relatively large in size. The PTC used in the battery for the electronic device is also large in size. As the technology advance in recent year, the portable electronic devices are getting smaller, lighter, and more functions. The devices demand much more current in use and longer service life. However, due to the high volume resistivity (>0.2Ω-cm) of carbon black, the carbon black loaded PTC device consumes too much energy and shortens the service life. Therefore, it is much desirable to have over current protection PTC device with volume resistivity less than 0.1 Ω-cm.

Because providing protection at low temperature is necessary for the over-current protection to a battery, the PTC conductive composite material usually uses polymer of a low melting temperature as matrix thereof, e.g., low density polyethylene (LDPE). As a result, the trip temperature is reached at a relatively low temperature, so that explosion of or damage to the battery due to over-temperature can be avoided.

However, if the PTC conductive composite material comprising LDPE matrix is used for a long time, the resistance thereof will increase gradually. For example, if it is subjected to a thermal shock between −40° C. and +85° C. for 100 cycles, the resistance thereof will increase from 10 mΩ initially to above 1Ω. The resistance cannot return to the initial value, so the device is not suitable for low resistance electric apparatus such as a battery.

As is well known, adding HDPE to the LDPE matrix can solve the above resistance drift problem. LDPE and HDPE, however, may form a compatible polymer blend which means that LDPE and HDPE could be partially dissolved into each other. Due to the presence of high crystalline HDPE, the melting point of the polymer blend could be dominated by the HDPE when HDPE exceeds 25% of the polymer weight. Accordingly, the trip temperature of LDPE with HDPE added is obviously higher than that of pure LDPE as shown in FIG. 1. In other words, the trip temperature of the PTC conductive composite material is increased, thus protection at low temperatures cannot be achieved. Therefore, if it is used in lithium ion batteries, explosion or burning of the batteries may occur.

In view of the above, there is a tradeoff between increasing the resistance repeatability and decreasing trip temperature. There remains a need for a breakthrough for low load applications.

SUMMARY OF THE INVENTION

The objective of the present invention is to provide an over-current protection device in which crystalline polymer of a high melting temperature is introduced into PTC conductive composite material to obtain superior resistance repeatability and low temperature trip protection of the over-current protection device.

In order to achieve the above objective, an over-current protection device is disclosed. The over-current protection device comprises two metal foils and a PTC material layer laminated between the two metal foils. The PTC material layer essentially comprises a polymer matrix and conductive filler. The polymer matrix at least comprises a first crystalline polymer and a second crystalline polymer in which the difference between the melting temperature of the second crystalline polymer and the melting temperature of the first crystalline polymer is greater than 50° C. The first crystalline polymer of an embodiment of the present invention is LDPE with a melting temperature of around 105° C., whereas the second crystalline polymer could be fluorine polymer such as polyvinylidine fluoride (PVDF) of a melting temperature around 165° C. The conductive filler could be metallic grain of a volumetric resistivity less than 500μΩ-cm, e.g., nickel powder, or non-oxide ceramic powder such as titanium carbide (TiC) or tungsten carbide (WC), and is distributed in the polymer matrix. The initial volumetric resistivity Ri of the PTC material layer is less than 0.1Ω-cm, and the trip temperature of the PTC material layer when the resistivity increases to be 1000 times the initial resistivity Ri minus the melting temperature of the first crystalline polymer is less than 15° C. In other words, the trip temperature of the PTC material (e.g. 108° C. of Experiment 1) is closer to the low melting point of the first crystalline polymer (e.g. 105° C.) than to the high melting point of the second crystalline polymer (e.g. 165° C.).

Moreover, if the PTC material layer is subjected to thermal shock between −40° C. and 85° C. for 100 cycles, the resistance thereof is less than 100 times the initial resistance. The first crystalline polymer in the PTC material layer is less than 20% by weight, whereas the second crystalline polymer in the PTC material layer is between 1-10% by weight.

The LDPE in the PTC material layer can be polymerized by Ziegler-Natta or Metallocene catalysts, or be made through co-polymerizing polyethylene monomers and other monomers such as butane, hexene, octane, acrylic acid or vinyl acetate.

Moreover, non-conductive filler can be added into the PTC material layer. For example, inorganic compound capable of flame retardation or anti-arcing such as zinc oxide, antimony oxide, aluminum oxide, silicon oxide, calcium carbonate, magnesium sulfate, barium sulfate and compound including hydroxyl base (OH) such as magnesium hydroxide, aluminum hydroxide, calcium hydroxide, or barium hydroxide. The grain size of the non-conductive filler is between 0.05 μm and 50 μm, and the non-conductive filler of the PTC material layer is between 1%-20% by weight.

For safety of lithium ion battery while being charged, the over-current protection device in use should be able to trip at a relatively low temperature, and have superior recovery or reappearance of resistance. The over-current protection device can overcome the tradeoff that the two above requirements cannot meet concurrently, and thus can be used for low load applications and provide protection at a low temperature.

DETAILED DESCRIPTION OF THE INVENTION

The PTC materials with different ratios of PVDF addition are exemplified as follows, so as to demonstrate the features of resistance reappearance and low trip temperature of the over-current protection device of the present invention.

Table 1 shows the ingredients of the PTC material layer in which low density polyethylene (LDPE) uses Taisox 6330F of Formosa Plastic Corporation, high density polyethylene (HDPE) uses Taisox 8010 of Formosa Plastic Corporation, PVDF uses Kynar 740 of Elf Autochem, and titanium carbide (TiC) uses 22R-0601 of Inframat Advantest Materials. Experiments 1, 2 and 3 add different percentages by weight of PVDF; they are 2.227%, 4.17% and 3.35%, respectively. Examples of Comparisons 1 and 2 have no PVDF addition.

TABLE 1

| | Ingredient (g) | | | |
|---|---|---|---|---|
| | LDPE | HDPE | PVDF | TiC |
| Experiment 1 | 9.6 | 2.2 | 3.0 | 117.6 |
| Experiment 2 | 8.4 | 1.7 | 5.4 | 113.7 |
| Experiment 3 | 10.3 | 0 | 4.4 | 116.4 |
| Comparison 1 | 8.0 | 6.7 | 0 | 111.7 |
| Comparison 2 | 13.0 | 1.5 | 0 | 117.6 |

The melting temperature of LDPE is around 105° C., the melting temperature of HDPE is around 130° C., and the melting temperature of PVDF is around 165° C. Titanium carbide (TiC) serves as the conductive filler and has a volumetric resistivity of around 150 μΩ-cm. TiC can be replaced with other metallic or non-oxide ceramic conductive fillers having a volumetric resistivity less than 500 μΩ-cm whereby the PTC material mixed by them has a volumetric resistivity lower than 0.1Ω-cm. In comparison with the carbon black serving as conductive filler and generally having a volumetric resistivity larger than 0.1Ω-cm, the metallic or non-oxide ceramic conductive fillers can reduce the resistance effectively, such that they are suitable for use in low load applications.

The materials of the above experiments and comparisons are put in a steel cup and mixed together, and then blended in a HAAKE-600 batch blender. The material input temperature of blending is 210° C. The initial speed of the blender is 40 rpm, and the speed increases to 70 rpm after three minutes. Then, the materials are output after being blended for 12 minutes, so as to form a conductive composite material exhibiting PTC behavior.

Figure 1:
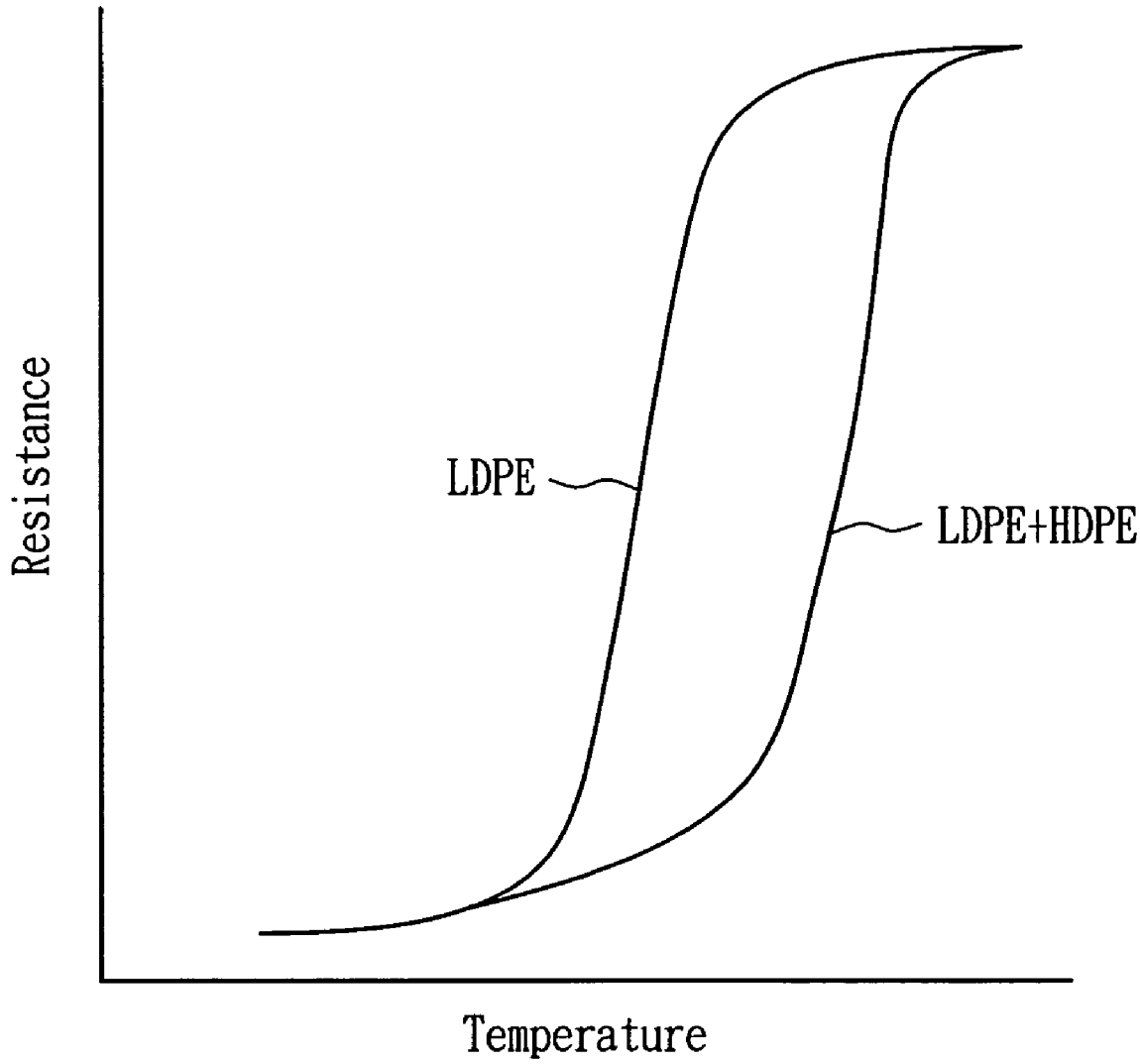
FIG. 1 (Prior Art)
FIG. 1 illustrates the relations of temperature vs. resistance of a PTC composite material with and without HDPE addition.
Figure 2:
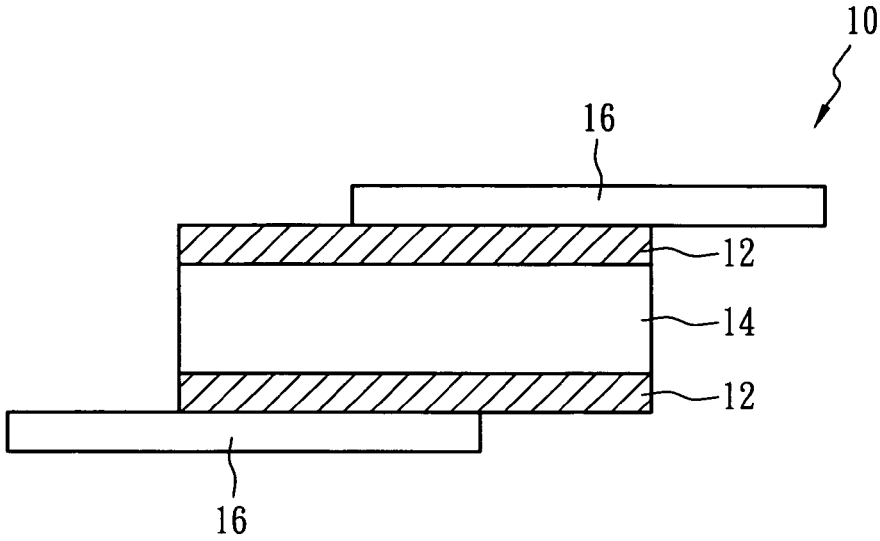
FIG. 2 illustrates an over-current protection device of an embodiment in accordance with the present invention.
Figure 3:
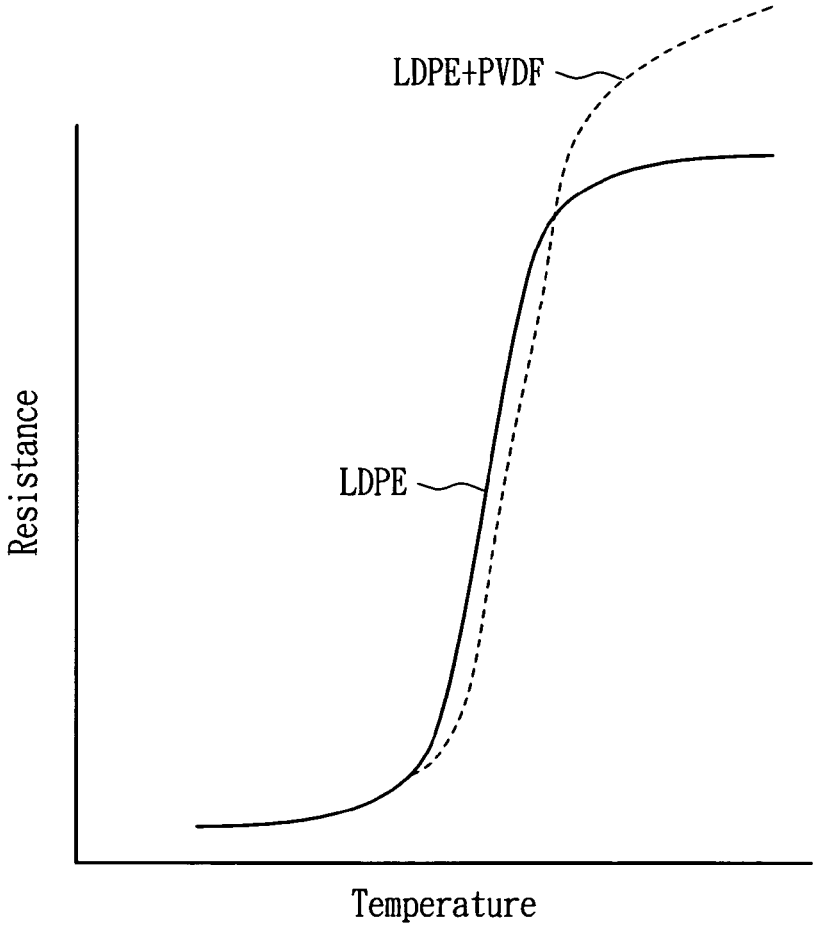
FIG. 3 illustrates the relations of temperature vs. resistance of a PTC composite material with and without PVDF addition.

The conductive composite material is put into a mold having a steel housing with a middle portion of a thickness of 0.4 mm in a vertically symmetrical manner. The upper and lower surfaces of the mold are covered by Teflon mold-release cloths. The conductive composite material is pre-heated for 8 minutes and hot-pressed for 2 minutes under a pressure of 100 kg/cm$^2$ and at a temperature of 200° C. to form a PTC material layer. The PTC material layer is then cut into squares of 20×20 cm$^2$, and metal foils, e.g., nickel plated copper foil, are pressed on the upper and lower surfaces of the PTC material layer. Afterwards, the PTC material layer is preheated for 5 minutes and pressed for 2 minutes under a pressure of 50 kg/cm$^2$ and at a temperature of 200° C. to firmly secure the metal foils onto the upper and lower surfaces of the PTC material layer. The PTC material layer with metal foils is cut into PTC chips of 3.4×4.1 mm$^2$, and then two electrodes, e.g., nickel plates, copper plates or metal plates of the alloy thereof, are respectively soldered onto the two metal foils on the upper and lower surfaces of the PTC material layer by tin soldering paste, so as to form an axial PTC device of the present invention as shown in FIG. 2. Accordingly, the over-current protection device 10 comprises a PTC material layer 14, two metal foils 12 and two electrodes 16, the PTC material layer 14 being laminated between the two metal foils 12, and the two electrodes 16 are connected to surfaces of the two metal foils 12, respectively.

The initial resistance Ri, volumetric resistivity of the PTC material layer 14, the temperature at which resistance of the PTC material layer 14 increases to 1000 Ri, i.e., the trip temperature, and the resistance of the PTC material layer 14 after being subjected to thermal shock between −40° C. and +85° C. for 100 cycles are measured and shown in Table 2. The resistances are measured by micro-ohmmeter 4-wire test, whereas the volumetric resistivity ρ is calculated in accordance with the following equation (1).

$$\rho = \frac{R \times A}{L} \tag{1}$$

wherein R is the resistance (Ω) of the PTC material layer 14, A is the area (cm$^2$) of the PTC material layer 14, and L is the thickness (cm) of the PTC material layer 14.

TABLE 2

| | Volumetric Resistivity (Ω-cm) | Initial Resistance Ri (Ω) | Temperature at which resistance increases to 1000 Ri (° C.) | Resistance after thermal shock 100 cycles (Ω) |
|---|---|---|---|---|
| Experiment 1 | 0.0224 | 0.0066 | 108 | 0.0125 |
| Experiment 2 | 0.0313 | 0.0092 | 105 | 0.0226 |
| Experiment 3 | 0.0296 | 0.0087 | 108 | 0.0120 |
| Comparison 1 | 0.0190 | 0.0056 | 121 | 0.213 |
| Comparison 2 | 0.0299 | 0.0088 | 108 | 1.201 |

In view of the ingredients shown in Table 1 and experiment data shown in Table 2, we can conclude that:

1. The trip temperature of the PTC device is defined as the temperature when the resistance thereof increases to 1000 times the initial resistance Ri. The trip temperatures of Experiments 1, 2 and 3 with different PVDF additions are 108° C., 105° C. and 108° C., respectively, which differ from the melting temperature of LDPE within 5° C. Moreover, each of the trip temperatures minus the melting temperature of LDPE can be controlled below 15° C., which is practical for applications. In contrast, the trip temperature of Comparison 1 without PVDF addition increases to 121° C., thus reducing the function for over-current protection at low temperatures. Comparison 2 has no PVDF addition but contains HDPE with a low ratio in comparison with LDPE. Therefore, the trip temperature does not increase significantly. However, the resistance after being subjected to thermal shock between 40° C. and +85° C. significantly increases from 0.0088Ω to 1.201Ω, which is not suitable for applications of low load with high current.

2. Titanium carbide of around 150Ω-cm, serving as the conductive filler, is added in the above Experiments and Comparisons, thereby the volumetric resistivities thereof are less than 0.1Ω-cm, which is much lower than that using carbon black as the conductive filler.

3. Because Comparison 2 includes addition of HDPE, the resistance only increases from 0.0056Ω to 0.213Ω after thermal shock between −40° C. and +85° C., which is still in a usable range. However, the trip temperature increases to 121° C. and thus cannot be used for low temperature protection. In contrast, the resistances of Experiments 1, 2 and 3 after thermal shock are less than 100 times the initial resistance, and more precisely are less than 30 times the initial resistance. The differences between the trip temperatures and the melting temperature of LDPE are less than 15° C., and more precisely are less than 5° C.

To sum up, addition of PVDF in accordance with the present invention can significantly reduce the resistance after thermal shock so as to increase the lifetime of the over-current protection device, and the increase of trip temperature due to HDPE addition as with the prior art can be avoided. Thus, the PTC device can provide protection at low temperature. The addition of crystalline polymer is not limited to PVDF; other polymers having equivalent characteristics also can be used.

The above-described embodiments of the present invention are intended to be illustrative only. Numerous alternative embodiments may be devised by those skilled in the art without departing from the scope of the following claims.

What is claimed is:

1. An over-current protection device, comprising:

two metal foils; and a positive temperature coefficient (PTC) material layer laminated between the two metal foils, comprising:

(1) a polymer matrix at least comprising a first crystalline polymer and a second crystalline polymer, with the melting temperature of the second crystalline polymer being higher than that of the first crystalline polymer by at least 50° C.; and (2) a conductive filler distributed in the polymer matrix with the volumetric resistance thereof being less than 500 μΩ-cm;

wherein the PTC material layer has a volumetric resistivity less than 0.1Ω-cm, and the trip temperature at which a resistance of the PTC material layer increases to 1000 times initial resistance thereof subtracting a melting temperature of the first crystalline polymer is less than 15° C.

2. The over-current protection device in accordance with claim 1, wherein the resistance of PTC material layer is less than 100 times the initial resistance thereof after being subjected to thermal shock between −40° C. and 85° C. for 100 cycles.

3. The over-current protection device in accordance with claim 1, wherein the first crystalline polymer in the PTC material layer is less than 20% by weight.

4. The over-current protection device in accordance with claim 1, wherein the second crystalline polymer is fluorine polymer.

5. The over-current protection device in accordance with claim 4, wherein the fluorine polymer is polyvinylidine fluoride (PVDF).

6. The over-current protection device in accordance with claim 1, wherein the first crystalline polymer is low density polyethylene.

7. The over-current protection device in accordance with claim 1, wherein the second crystalline polymer in the PTC material layer is between 1-10% by weight.

8. The over-current protection device in accordance with claim 1, wherein the conductive filler is metallic grain or non-oxide ceramic powder.

9. The over-current protection device in accordance with claim 1, wherein the conductive filler is nickel powder or titanium carbide.

10. The over-current protection device in accordance with claim 1, further comprising two electrodes connected to the two metal foils.

* * * * *